US009764333B2

(12) United States Patent
Dick et al.

(10) Patent No.: US 9,764,333 B2
(45) Date of Patent: Sep. 19, 2017

(54) ELECTRICAL IONIZER FOR AEROSOL CHARGE CONDITIONING AND MEASUREMENT

(75) Inventors: William Dick, Minneapolis, MN (US); Francisco J. Romay, Vadnais Heights, MN (US); Benjamin Y. H. Liu, North Oaks, MN (US)

(73) Assignee: MSP CORPORATION, Shoreview, MN (US)

( * ) Notice: Subject to any disclaimer, the term of this patent is extended or adjusted under 35 U.S.C. 154(b) by 1022 days.

(21) Appl. No.: 12/902,871

(22) Filed: Oct. 12, 2010

(65) Prior Publication Data

US 2011/0220811 A1 Sep. 15, 2011

Related U.S. Application Data

(60) Provisional application No. 61/312,455, filed on Mar. 10, 2010.

(51) Int. Cl.
*B03C 3/38* (2006.01)

(52) U.S. Cl.
CPC ..... *B03C 3/38* (2013.01)

(58) Field of Classification Search
None
See application file for complete search history.

(56) References Cited

U.S. PATENT DOCUMENTS 3,417,606 A * 12/1968 Werner et al. ..... 73/24.01
3,520,172 A * 7/1970 Liu et al. ..... 73/28.04
5,889,404 A 3/1999 Abdel-Rahman et al.
6,544,484 B1 * 4/2003 Kaufman et al. ..... 422/186.04
7,031,133 B2 4/2006 Riebel et al.
2006/0093737 A1 * 5/2006 Dick et al. ..... 427/180

FOREIGN PATENT DOCUMENTS

CN 101581698 A 11/2009
DE 19812852 A1 9/1999
EP 1837489 A1 9/2007
SU 1504216 8/1989
WO 2005039780 A2 5/2005
(Continued)

OTHER PUBLICATIONS

European Search Report, Jul. 11, 2011.
(Continued)

*Primary Examiner* — Jack Berman
(74) *Attorney, Agent, or Firm* — Westman, Champlin & Koehler, P.A.; Z. Peter Sawicki; Amanda M. Prose

(57) ABSTRACT

A method and apparatus are disclosed for exposing particles in a gas in order to cause the charge on the particles to change, the apparatus comprising a chamber having a conductive wall with a gas inlet and a gas outlet. An electrode with an exposed tip is in the chamber, the electrode being held at a different potential from the ground potential. The electrode is connected to a source of voltage sufficient to cause a corona discharge to occur forming ions in the chamber, and creating a region with a high electric field intensity and another region in which the electric field intensity is lower. The inlet and outlet define a gas flow path from the inlet to the outlet such that the gas flow path passes mainly through the region with the lower electric field intensity.

7 Claims, 8 Drawing Sheets

(56) References Cited

FOREIGN PATENT DOCUMENTS

| | | | |
|---|---|---|---|
| WO | 2005115088 | A2 | 12/2005 |
| WO | 2010003613 | A1 | 1/2010 |

OTHER PUBLICATIONS

European Written Opinion, Jul. 11, 2011.
B. Y. H. Liu and D. Y. H. Pui, "Electrical Neutralization of Aerosols," J. Aerosol Sci. 5:465-472 (1974).
B. Y. H. Liu, D. Y. H. Pui and B. Y. Lin, "Aerosol Charge Neutralization by Radioactive Alpha Source," Particle Characterization, 3:111-116 (1986).
F. J. Romay., B. Y. H. Liu and D.Y.H. Pui, "A Sonice Jet Corona Ionzer for Electrostatic Discharge and Aerosol Neutralization," Aerosol Sci. and Technol. 20:31-34 (1994).
Product Information Bulletin, Model 1000XP, Wide Range Particle Spectrometer, MSP Corporation (2008).
W.C. Hinds, Aerosol Technology, p. 303, Wiley (1982).
Extended European Search Report; Mar. 6, 2013.

* cited by examiner

ELECTRICAL IONIZER FOR AEROSOL CHARGE CONDITIONING AND MEASUREMENT

CROSS-REFERENCE TO RELATED APPLICATION

The present application is based on and claims the benefit of U.S. provisional patent application Ser. No. 61/312,455, filed Mar. 10, 2010, the content of which is hereby incorporated by reference in its entirety.

FIELD OF THE INVENTION

This invention relates to a method and an apparatus for conditioning the charge on aerosol particles for size distribution measurement by differential mobility spectrometry. Specifically, this disclosure relates to an electrical ionizer for generating positive and negative ions by corona discharge in a gas in order to condition the aerosol particle charge to a desired degree needed for the measurement. In comparison with other electrical ionizers developed in the past, the present method and apparatus offer the simplicity, reliability, ease of use, and accuracy approaching that of traditional radioactive ionizers used for such purposes. In addition to aerosol measurement by differential mobility spectrometry, the electrical ionizer can also be used for a variety of other applications where charging or charge conditioning of particles in a gas is an important consideration and requirement.

BACKGROUND OF THE INVENTION

Solid and/or liquid particles suspended in a gas are referred to as aerosols, which are present naturally in the ambient atmosphere or as a result of man-made activities. Method and apparatus for measuring particles suspended in a gas are important for atmospheric aerosol research and in other scientific and technical disciplines where small particles suspended in a gas play a significant role.

An important method to measure the concentration and size distribution of aerosol particles is differential mobility spectrometry. For such a measurement the aerosol particles, i.e. particles suspended in a gas, must be conditioned in order to create a specific charge distribution on the particles. Particles not properly charge conditioned will give rise to erroneous results. The Wide-Range Particle Spectrometer (WPS™) manufactured by MSP Corporation (Product Information Bulletin, Model 1000XP, Wide Range Particle Spectrometer, MSP Corporation (2008)) is one such instrument capable of measuring aerosol size distributions from 0.01 μm to 10 μm in diameter. In this instrument, a sub-range of aerosol particle size from 0.01 to 0.5 μm is measured by differential mobility or scanning mobility spectrometry. For the purpose of this disclosure we will refer to both measurement approaches as differential mobility spectrometry, or DMS, since both are based on the differential mobility measuring principle. Instruments based on differential mobility spectrometry are available from several manufacturers. The electrical ionizer described in this disclosure can in principle be used with any one of these aerosol measuring instruments.

Traditionally, aerosol charge conditioning for DMS is accomplished by means of a radioactive ionizer. Two commonly used radioactive ionizers are Krypton 85 and Polonium 210 (B. Y. H. Liu and D. Y. H. Pui, "Electrical Neutralization of Aerosols, " J. Aerosol Sci. 5:465-472 (1974) and B. Y. H. Liu, D. Y. H. Pui and B. Y. Lin, "Aerosol Charge Neutralization by Radioactive Alpha Source," Particle Characterization, 3:111-116 (1986)). These radioactive ionizers make use of high-energy subatomic particles produced by radioactive decay to ionize the gas to form positive and negative ions needed for charge conditioning. Krypton 85 is a beta emitter, producing high-energy beta particles, i.e. electrons, by radioactive decay. Polonium 210 is an alpha emitter producing energetic subatomic alpha particles, which are the nuclei of helium atoms. These energetic sub-atomic particles then collide with gas molecules to form positive and negative ions for charge conditioning. These sub-atomic particles are much smaller than the size of a single atom, which is approximately 1.0 Å in the case of hydrogen. Alpha and beta particles are considerably smaller than 1.0 Å in size.

In comparison, aerosol particles are considerably larger. An aerosol particle with a diameter of 1.0 nm, which is 10 Å, is considered very small in aerosol studies and is near the lower size limit of particle measurement by DMS. Aerosol of such a small size is therefore much larger than particles of nuclear physics. Particles of nuclear physics are very different from the particles of interest in aerosol studies. These two types of particles are not the same and should be clearly distinguished. For the purpose of this disclosure, unless otherwise noted, the particles of interest are aerosol particles rather than sub-atomic particles of nuclear physics.

When gas containing suspended aerosol particles is exposed to energetic sub-atomic particles produced by radioactive decay, the gas becomes ionized to form positive and negative ions. The gaseous ions then collide with the suspended aerosol particles to produce a characteristic charge distribution referred to as a Boltzmann distribution (W. C. Hinds, Aerosol Technology, p. 303, Wiley (1982)), $$fn = \frac{\exp(-n^2e^2/dkT)}{\sum_{n=-\infty}^{\infty} \exp(-n^2e^2/dkT)}$$

where e is the elementary unit of charge, d is the particle diameter, k is Boltzamann's constant, T is the absolute temperature, n is the number of elementary units of charge on the particles and $f_n$ is the fraction of particles in the aerosol carrying n elementary units of charge. Table 1 shows the particle charge distribution according to the Boltzmann's law.

An aerosol in Boltzmann charge equilibrium will develop a charge distribution with substantially equal concentration of positively and negatively charged particles. The total charge on the particles, i.e. the sum of all positive and negative charges carried by the particles, is equal to zero. As a result, an aerosol in Boltzmann charge equilibrium has no overall net charge. Overall the aerosol is electrically neutral while the individual particles in the aerosol may carry a charge, although not all particles are charged. The conditions needed to produce Boltzmann charge distribution are discussed in B. Y. H. Liu and D. Y. H. Pui, "Electrical Neutralization of Aerosols," 5. Aerosol Sei. 5:465-472 (1974) and B. Y. H. Liu, D. Y. H. Pui and B. Y. Lin, "Aerosol Charge Neutralization by Radioactive Alpha Source," Particle Characterization, 3:111-116 (1986).

TABLE 1

(from Hinds, 1982; page 302)
Distribution of Charge on Aerosol Particles at Boltzmann Equilibrium

| Particle Diameter | Average | Percentage of Particles Carrying the Indicated Number of Charges | | | | | | | | |
|---|---|---|---|---|---|---|---|---|---|---|
| μm | Charge | <−3 | −3 | −2 | −1 | 0 | +1 | +2 | +3 | >+3 |
| 0.01 | 0.007 | | | | 0.3 | 99.3 | 0.3 | | | |
| 0.02 | 0.104 | | | | 5.2 | 89.6 | 52 | | | |
| 0.05 | 0.411 | | | 0.6 | 19.3 | 60.2 | 19.3 | 0.6 | | |
| 0.10 | 0.672 | | 0.3 | 4.4 | 24.1 | 42.6 | 24.1 | 4.4 | 0.3 | |
| 0.20 | 1.000 | 0.3 | 2.3 | 9.6 | 22.6 | 30.1 | 22.6 | 9.6 | 2.3 | 0.3 |
| 0.50 | 1.64 | 4.6 | 6.8 | 12.1 | 17.0 | 19.0 | 17.0 | 12.1 | 6.8 | 4.6 |
| 1.00 | 2.34 | 11.8 | 8.1 | 10.7 | 12.7 | 13.5 | 12.7 | 10.7 | 8.1 | 11.8 |
| 2.00 | 3.33 | 20.1 | 7.4 | 8.5 | 9.3 | 9.5 | 9.3 | 8.5 | 7.4 | 20.1 |
| 5.00 | 5.28 | 29.8 | 5.4 | 5.8 | 6.0 | 6.0 | 6.0 | 5.8 | 5.4 | 29.8 |
| 10.00 | 7.47 | 35.4 | 4.0 | 4.2 | 4.2 | 4.3 | 4.2 | 4.2 | 4.0 | 35.4 |

When an aerosol carrying suspended particles are charge-conditioned by flowing the aerosol through a radioactive ionizer under suitable operating conditions, it will emerge from the ionizer carrying the charge distribution shown in Table 1. This specific charge distribution is then used for size distribution analysis by DMS.

An electrical ionizer for aerosol charge conditioning and measurement by DMS, therefore, must generate a charge distribution similar to the Boltzmann charge distribution generated by a radioactive ionizer in order to achieve accurate measurement results. One difference between radioactive ionizer and electric ionizer is that ionization by sub-atomic particles produced by radioactive decay occurs in the absence of an external electric field, whereas charge conditioning by ions generated by corona discharge frequently occurs when there is a significant electric field present. Not all electrical ionizers are thus capable of charge conditioning an aerosol to a sufficient degree to produce a Boltzmann distribution. As a result, an electrical ionizer capable of generating a charge distribution similar to the Boltzmann distribution is needed for high accuracy aerosol measurement by DMS. Such an ionizer is now needed because of the increased regulation on the use of radioactive material, which makes the use of radioactive ionizers less attractive or convenient for scientific research and technical applications.

Other developments in electrical ionizers include those described in F. J. Romay, B Y. H. Liu and D. Y. H. Pui, "A Sonic Jet Corona Ionizer for Electrostatic Discharge and Aerosol Neutralization" Aerosol Sci. Technol, 20: 31-41 (1994) and in U.S. Pat. No. 6,544,484. Both use a DC corona discharge to generate separate streams of positive and negative ions in clean air, which are then mixed with an aerosol to provide positive and negative ions for charge conditioning. The aerosol is thus diluted, which is a disadvantage in some applications. Both devices have failed to achieve wide spread acceptance, perhaps as a result of complexity, reliability, and/or cost. Another approach to aerosol charge neutralization is by means of an AC corona discharge as described by Riebel et al in U.S. Pat. No. 7,031,133.

SUMMARY OF THE INVENTION

This disclosure includes an apparatus for exposing particles in a gas in order to cause the charge on the particles to change, the apparatus comprising a chamber with an inlet for the gas to enter and an outlet for the gas to exit. The chamber is surrounded by an enclosure with a conductive wall, the wall being held at a ground potential. An electrode with an exposed tip is in contact with the gas in the chamber, the electrode being held at a different potential from the ground potential. The inlet and outlet define a gas flow path from the inlet to the outlet such that the gas flow path passes mainly through a region of space with a low electric field intensity. The electrode is connected to a source of voltage sufficient to cause a corona discharge to occur forming ions in the chamber.

A method is also disclosed for conditioning a charge on particles in the gas to produce substantially equal concentrations of positively and negatively charged particles and a substantially zero total particle charge in said gas for aerosol measurement by differential mobility spectrometry, said method comprising causing said gas to flow thorough a chamber, the chamber having an inlet for the gas to enter and an outlet for the gas to exit and includes the gas to flow through a chamber along a gas flow path that extends from an inlet of the chamber to an outlet of the chamber, and creating an AC corona discharge within the chamber having a high electric field intensity region and a lower electric field intensity region with the gas flow from the inlet to the outlet occurring mainly in the lower intensity region thereby creating substantially equal concentrations of positively and negatively charged particles, and a substantially zero total particle charge in the gas.

DETAILED DESCRIPTION OF THE INVENTION

Figure 1:
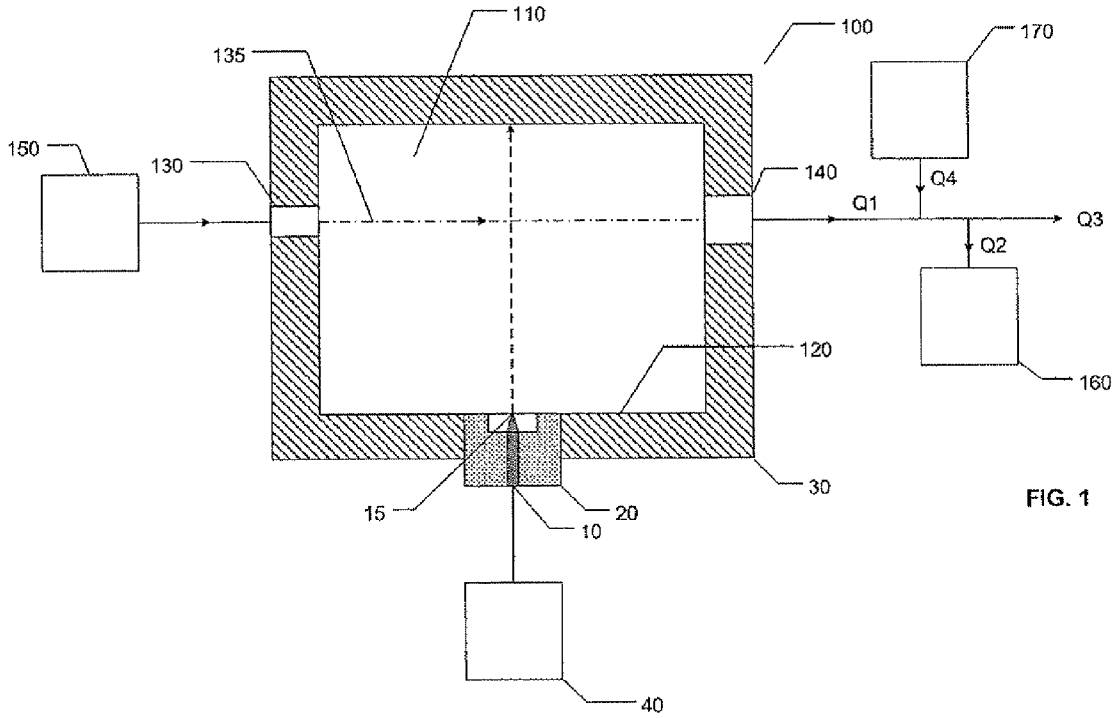
FIG. 1 is a schematic diagram of the system for measuring the concentration and size distribution of aerosol particles by DMS using the electrical ionizer of the present disclosure in its preferred embodiment as an aerosol charge conditioner.

FIG. 1 is a schematic diagram of the system for measuring the concentration and size distribution of aerosol particles by DMS using the electrical ionizer of the present disclosure as an aerosol charge conditioner. The electrical ionizer is shown generally at 100 in its preferred embodiment and is comprised of a housing, 30, which is electrically conductive and grounded, to provide an enclosure around the ionization chamber 110 whose walls are thus also conductive and grounded. Ionization chamber 110 has an inlet, 130, for the aerosol to enter and an outlet, 140, for the aerosol to exit. A high voltage electrode, 10, is held by insulator 20 and placed in the ionization chamber with an exposed electrode tip, 15, near one wall, 120, of the enclosure. The tip is exposed to the aerosol flowing through the ionization chamber carrying suspended particles for charge conditioning. The electrode is placed in a position close to the surface of wall 120 of the ionization chamber but separated from it by a sufficient distance so that a suitably high voltage applied to the electrode will cause a stable corona discharge to develop without arcing. A DC voltage of an appropriate polarity can be used to generate a DC corona of either a positive or a negative polarity for aerosol charging. An AC voltage can be used to create an AC corona discharge thus generating both positive and negatively charged ions in the ionization chamber for charge conditioning for DMS.

Aerosol for charge conditioning and measurement by DMS comes from source 150, which can be an aerosol in the ambient atmosphere for measurement by DMS for concentration and size distribution analysis. It can be an aerosol generated for laboratory research in which the aerosol size distribution is to be measured by DMS. The aerosol can also be generated by a specific process or for a specific purpose, in an industrial setting, where knowledge about the aerosol size distribution is important. In all cases, aerosol size distribution analysis by DMS can be made with the system shown in FIG. 1.

Aerosol from source 150 in FIG. 1 first flows through electrical ionizer 100 at a specific rate of flow, Q1, and under conditions that will insure a charge distribution similar to that of a Boltzmann distribution will develop. A measuring instrument 160 for size distribution analysis by DMS then samples the aerosol at a rate of flow, Q2, required for the measurement. If Q1 is larger than Q2, the excess, Q3=Q1−Q2, will be discharged as waste as shown. If Q1 is smaller than Q2, additional clean gas from source 170 can be introduced at a rate of flow Q4 to mix with the aerosol to provide a mixture having a total flow rate Q1+Q4 that is equal to or larger than the flow rate Q2. The excess, Q3=Q1+Q4−Q2, if any, can be discharged as waste as shown in FIG. 1.

Figure 2:
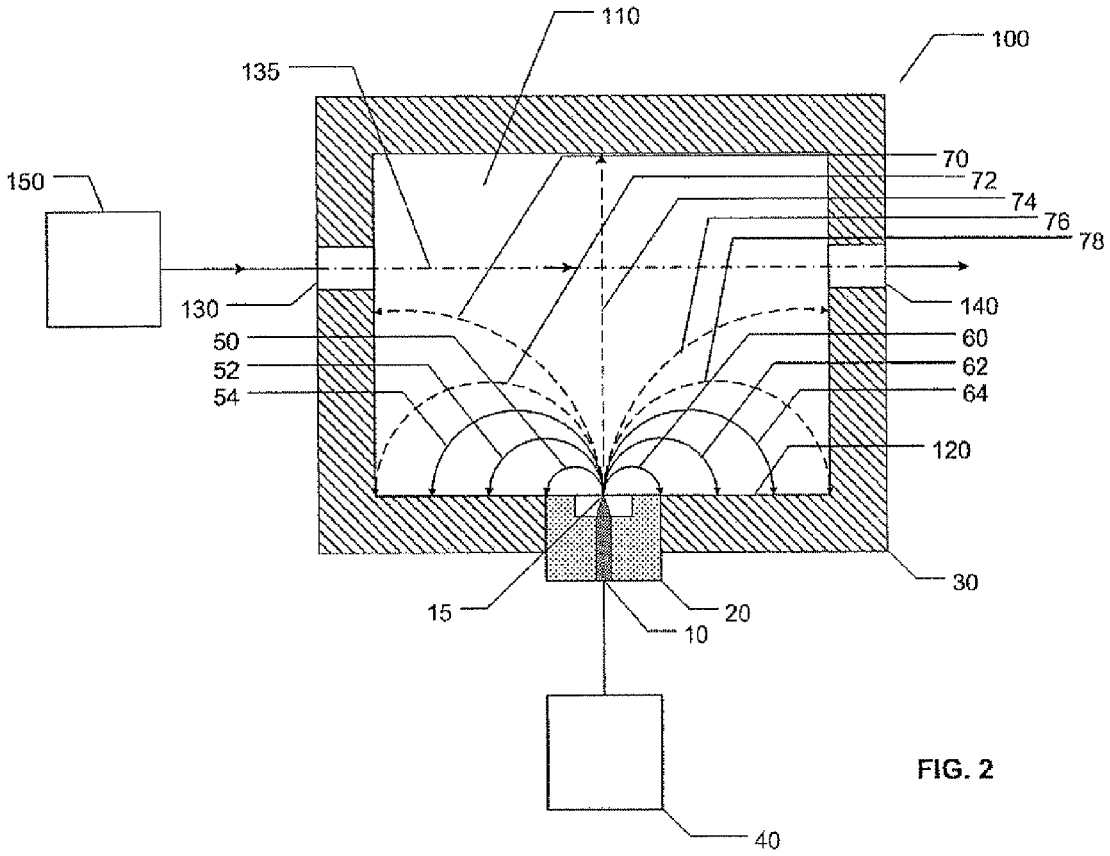
FIG. 2 is schematic diagram explaining the operating principle of the ionization chamber of the electrical ionizer in its preferred embodiment.

The operating principle of the electrical ionizer 100 is explained with the aid of FIG. 2. With the exposed high voltage electrode tip 15 being placed in a position near the surface 120 of one wall of the enclosure, an electric field will develop in the chamber. The electric field can be depicted by electric field lines, some of which are shown in FIG. 2. Electric field lines, 50, 52, 54, 60, 62, and 64, emanate from the tip 15 and terminate on the nearby wall surface 120, whereas field lines 70, 72, 74, 76 and 78 also emanate from the same high-voltage tip 15 but terminate on wall surfaces that are farther away. The depicted field lines, including lines 52, 54, 60, 62, 64 70, 72, 74, 76 and 78, all begin with an electrical potential equal to the potential, i.e. the voltage on the high-voltage electrode 10 at the tip 15, and end on the same grounded surface of the enclosure which is grounded and at a potential of 0 volt. The potential gradient, which is the rate of change of the electrical potential per unit length along an electric field line, is thus higher along the shorter electric field lines, 50, 52, 54, 60, 62 and 64, than along the longer electric field lines, 70, 72, 74, 76 and 78. The electric field intensity is the gradient of the electrical potential. Therefore, it is higher along the shorter electric field lines that terminate on the near-wall surface 120 adjacent to the electrode tip 15, than along those that terminate on surfaces of enclosure 30 that are farther away.

When gaseous ions are generated by a corona discharge in the region of space adjacent to the electrode tip 15, the ions will flow along the electric field lines at a velocity in proportion to the electric field intensity. The velocity of ions, which is referred to as the drift velocity, will thus be higher along the electric field lines with a high electric field intensity, and lower along the longer electric field lines with a lower electric field intensity. By creating two separate streams of ions, one flowing at a high velocity toward the near wall, i.e. wall near the high voltage electrode, and another flowing at a lower velocity toward the far wall, we have created two separate regions of space in the ionization chamber, in which one region on the average has a lower electric field intensity than the other. The region with a high electric field, i.e. electric field intensity, is the region of space below the boundary electric field lines 54 and 64, while the low electric field region is the region above these boundary field lines 54 and 64.

When using the ionization chamber depicted in FIG. 2 for charge conditioning of aerosol particles for DMS, it is important that charge-conditioning takes place mainly in the low field region, above the region of space in the vicinity of electric field lines 50, 52, 54, 60, 62, and 64 where the electric field is high. When the aerosol is introduced into the ionization chamber through inlet 130, its nominal flow path is the line 135 connecting the inlet 130 with the outlet 140. It is important that this flow path does not pass through the high field region surrounding the electrode tip and adjacent to surface 120, but mainly through the low field region above it.

Figure 3:
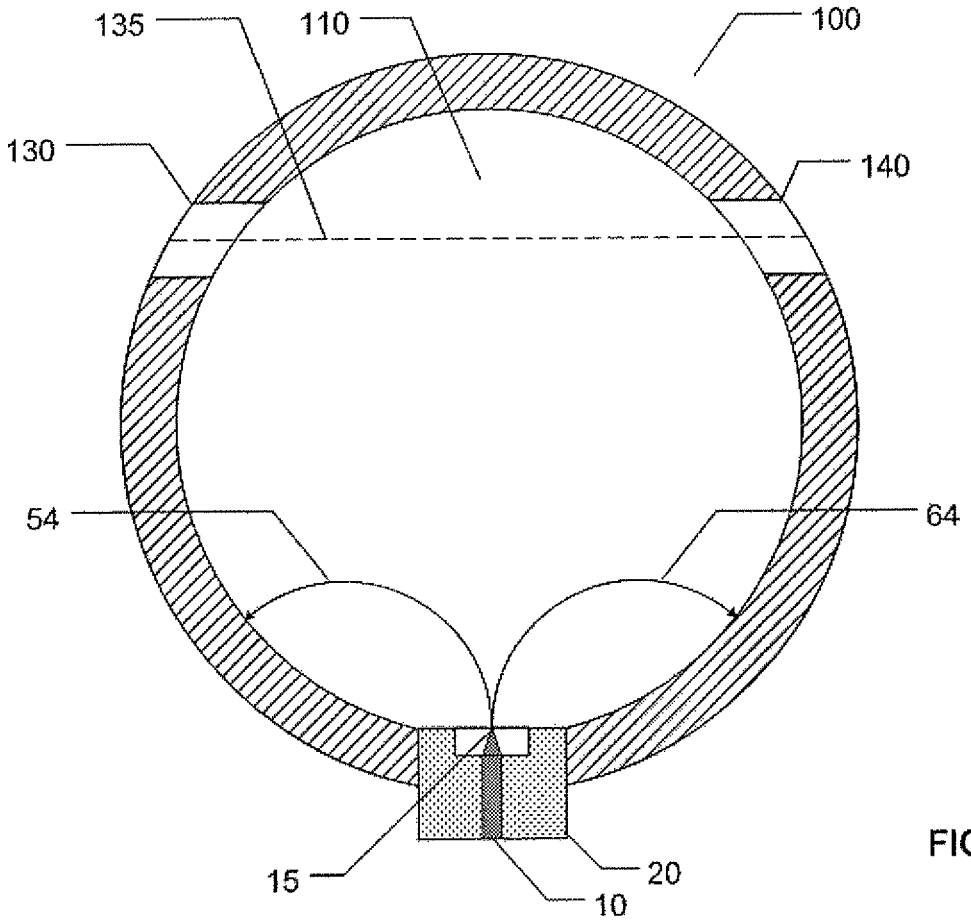
FIG. 3 is a schematic diagram of an electrical ionizer with a spherical ionization chamber.

The ionization chamber depicted in FIG. 1 and FIG. 2 can be a rectangular chamber with opposite walls that are parallel to each other. It can also depict a cylindrical chamber with parallel walls on the top and bottom separated by a circular cylinder or a cylinder with other cross sectional shapes such as the shape of an ellipse, a polygon, among others. The design approach described above in this disclosure is suitable for all of these ionization chamber cross-sectional shapes. In addition, the ionization chamber can have a curved wall such as the curved surface formed by a sphere, as depicted in FIG. 3. In FIG. 3 like reference characters are used to refer to like elements of the system as in FIG. 1 and FIG. 2, including the electrical ionizer, 100, the inlet 135 and the outlet 140 for the ionization chamber 110, the aerosol flow path 135, the high voltage electrode 10, its tip 15, and the insulating support 20. The outer most electric field lines 54 and 64 in the vicinity of the electrode 10 are also similarly identified. All of these parts have a similar function and are similarly identified for simplicity and clarity, in spite of the different ionization chamber shape used, which is a sphere in FIG. 3 and a rectangular or a cylindrical shaped chamber in FIG. 1 and FIG. 2.

Figure 4:
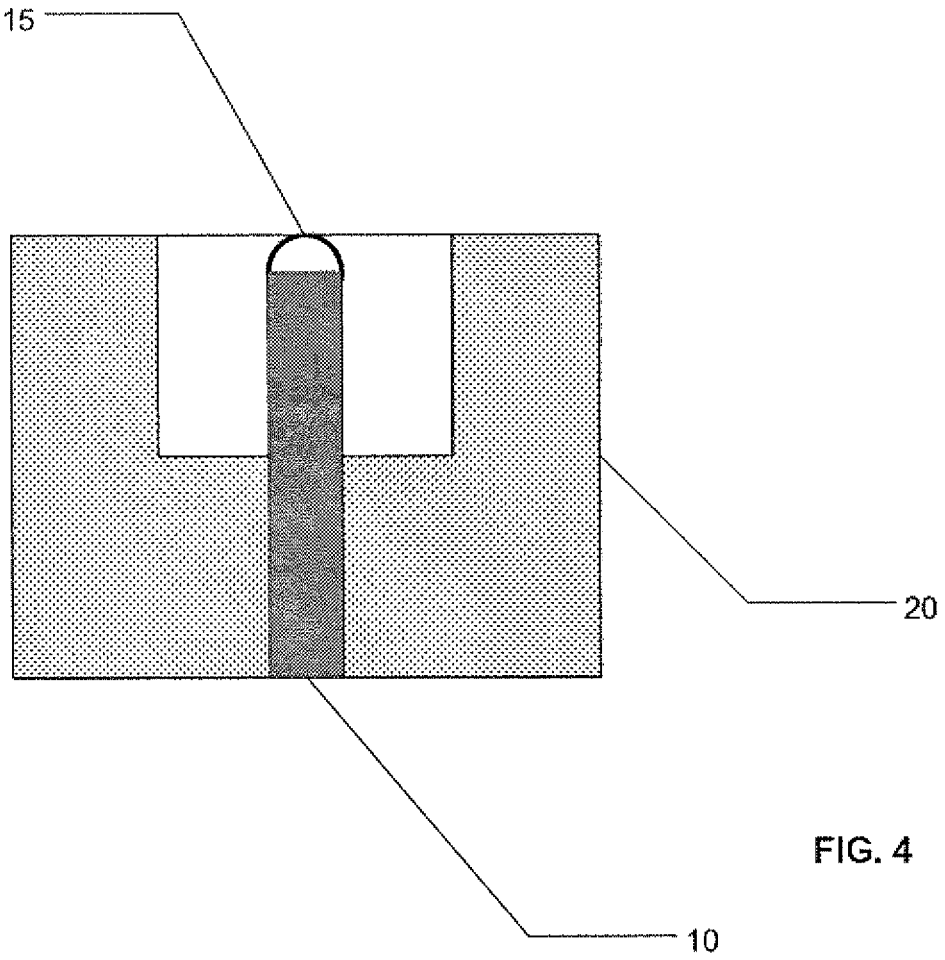
FIG. 4 is a high-voltage electrode with a small-diameter wire loop on one end to produce ions by corona discharge.

FIG. 4 shows another approach of electrode design. Again like parts are like identified. In this design, electrode 10 is held in an insulating support 20, topped by a tip 15 in the form of small wire loop, or a short length of a wire held mechanically at the top of electrode 10. The radius of curvature of the needle electrode shown in FIGS. 1-3 and the radius of the wire electrode 4 have a substantial influence on the voltage needed to start and sustain a corona discharge from the electrode. Generally, the smaller the radius of curvature of the tip or the radius of the wire, the lower will be the voltage needed to start and maintain a stable corona discharge. A sharp pointed or tapered tip is preferred. High discharge voltage will cause a greater rate of erosion by ion bombardment of the electrode tip, thus making it necessary to replace the electrode at frequent intervals. For practical purposes, a voltage in the range between 4000 to 7000 volts is considered the most appropriate for operating a high voltage electrode in the present disclosure. The voltage can be a DC voltage in this range, or an rms, i.e. root-mean-square AC voltage in this range.

The corona current flow from the high voltage electrode to the grounded electrode nearby also has an effect on the performance of the electrical ionizer. A high ionization current will generally lead to more rapid charge conditioning, and a low ionization current will require keeping the aerosol flow through the ionizer at a sufficiently low flow rate to insure the desired charge distribution similar to that of a Boltzmann distribution will indeed develop. This, however, can lead to greater undesired particle loss by electrostatic deposition in the ionization chamber. Such a loss is undesirable because it would lead to reduced measurement accuracy for DMS measurement. The most appropriate range of corona ion flow is in the range between 0.1 and 5 mA in rms AC current flow for proper charge conditioning for DMS aerosol measurement. In the case where a DC corona discharge is needed for creating a unipolar charge, i.e. charge of the same electrical polarity, either a positive or a negative polarity, the required DC current is also generally in the same 0.1 to 5 mA range.

In practical applications, it is also important to design the electrical ionizer suitable for different rate of aerosol flow needed by different applications. Too high of an aerosol flow rate or too small an ionization chamber volume will lead to incomplete charging or charge conditioning of the aerosol. Too large an ionization chamber or too low an aerosol flow rate through the ionization chamber will lead to greater losses of particles in the chamber, which is also undesirable. For the purpose of this disclosure, the most appropriate range is a range where the nominal residence time of the aerosol flow in the chamber, which is the ratio of chamber volume to the volumetric aerosol flow rate is within an appropriate range. An aerosol flow rate of 20 cubic centimeter per second through an ionization chamber having a 40 cubic centimeter volume will result in a nominal residence time of 40/20=2 seconds. The most appropriate residence time for designing ionization chambers is between 0.2 and 20 seconds.

Different application also requires different ionization chamber sizes. For charging and charge conditioning purposes for DMS, the ionization chamber is generally in the range between 6 to 600 cubic centimeters in total volume.

The above approach to designing electrical ionizers for aerosol charging and charge conditioning for laboratory aerosol studies and aerosol size analysis by DMS is generally adequate for most applications. A similar approach can be used to design electrical ionizers for other applications where accuracy of charging and charge conditioning are important, and where the loss of particles in flowing through the ionizer is also an important consideration. For those skilled in the art of aerosol measurement, it will become clear that the specific approach described in this disclosure can also be used to design electrical ionizers for those applications where the end applications may be different, but the factors affecting the acceptance of the electrical ionizer are similar or substantially the same. Further discussion of the application of the approach described in this disclosure for other applications, therefore, will not be made further.

FIGS. 5-8 compare laboratory measurement made on two aerosols by differential mobility spectrometry (DMS): (1) a laboratory room air aerosol and (2) aerosol with uniform sized particles of polystyrene latex sphere of 269 nm generated in the laboratory. In both cases the measurement was made with an electrical ionizer operating at a residence time of 2.0 seconds and a residence time of 0.67. Similar measurement was also made with a conventional Po 210 radioactive ionizer.

Figure 5:
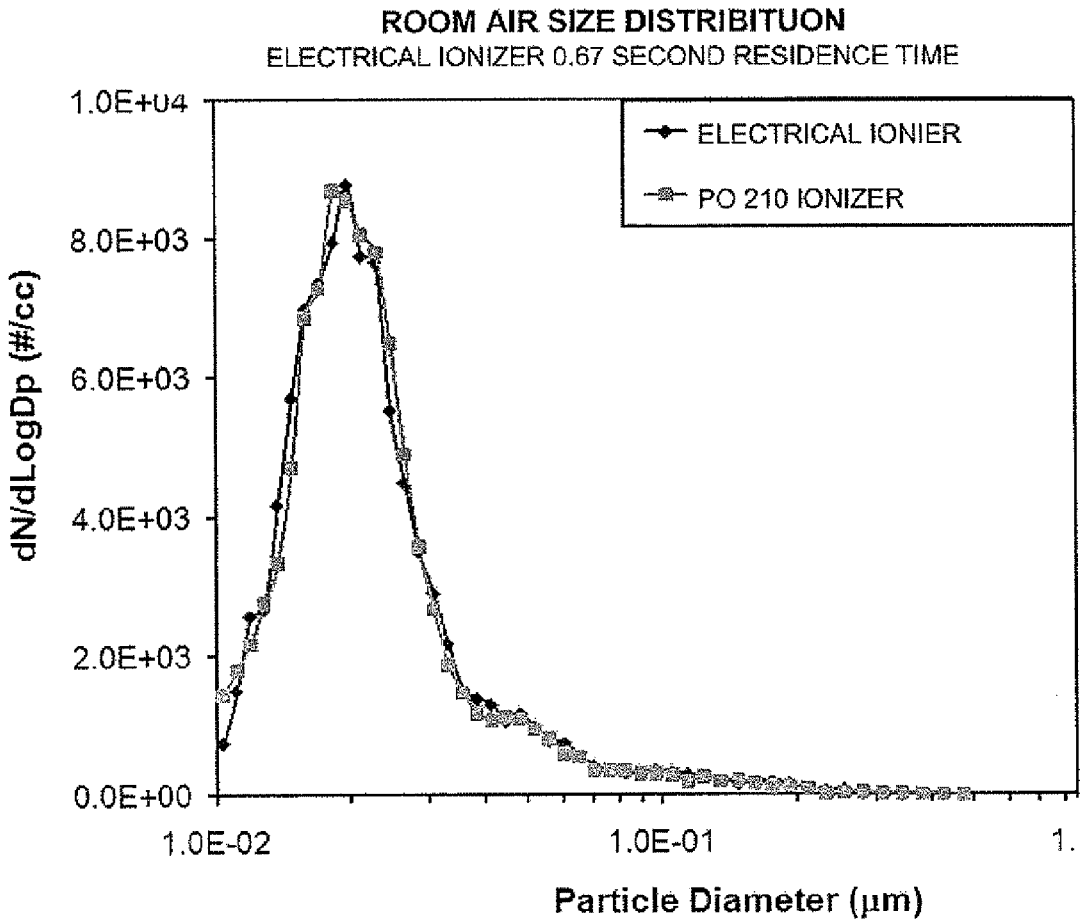
FIG. 5 shows the room air size distribution measured by DMS with a laboratory electrical ionizer operating at 0.67 second residence time compared to measurement made with a Po 210 ionizer.
Figure 6:
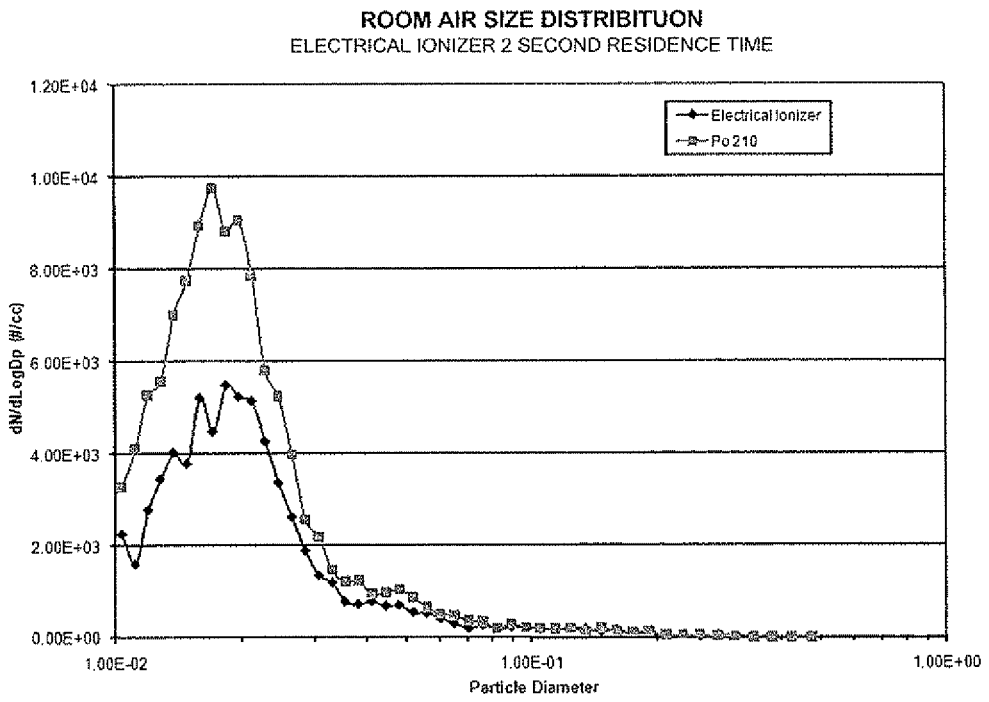
FIG. 6 shows the room air size distribution measured by DMS with a laboratory electrical ionizer operating at 2.0 second residence time compared to measurement made with a Po 210 ionizer.
Figure 7:
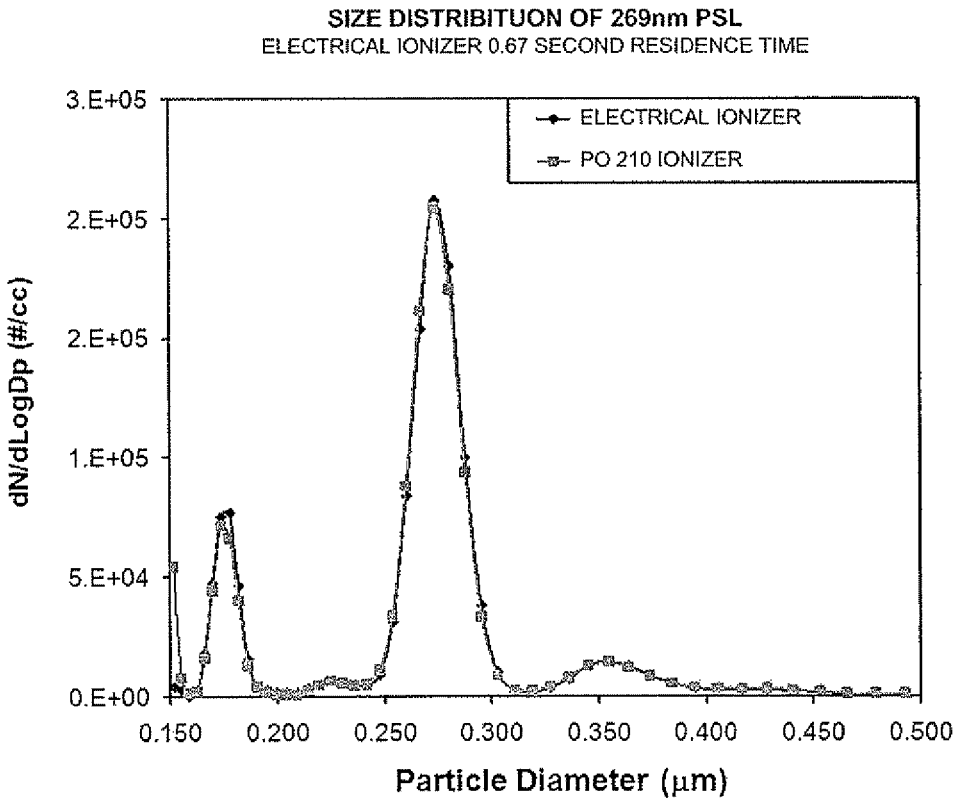
FIG. 7 shows measurements made by DMS with an electrical ionizer operating at 0.67 second residence time and that measured with a Po 210 ionizer for a polystyrene latex (PSL) sphere aerosol with a diameter of 269 nm.
Figure 8:
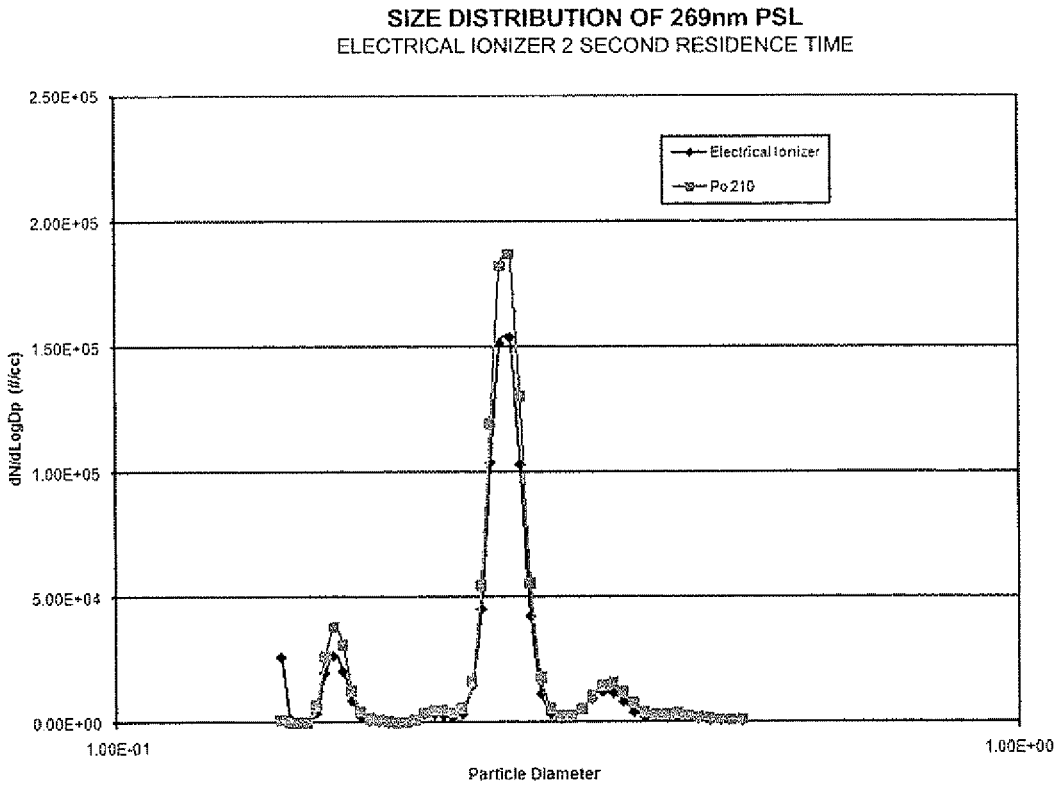
FIG. 8 shows a measurements made by DMS with an electrical ionizer operating at 2.0 second residence time compared to measurement made with a Po 210 ionizer for a polystyrene latex (PSL) sphere aerosol of 269 nm diameter.

Results in FIG. 5 and FIG. 6 show that qualitative agreement is achieved with an electric ionizer operating at 2.0 second with that measured with a Po 210 radio-active ionizer, while a quantitative agreement is achieved when the electrical ionizer is operated at a residence time of 0.67 seconds. Similar results are achieved as shown FIG. 7 and FIG. 8 for the case of polystyrene latex (PSL) aerosol containing uniform sized 269 nm PSL spheres.

These and other laboratory studies we have made show that the specific approach described in this disclosure to designing electrical ionizer for aerosol charge conditioning and measurement by DMS will lead to accurate measurement results. The approach can also be used for other applications where charging or charge-conditioning of aerosols are important.

Although the present invention has been described with reference to preferred embodiments, workers skilled in the art will recognize that changes may be made in form and detail without departing from the spirit and scope of the invention.

What is claimed is:

1. An apparatus for exposing particles in a gas to ions in order to cause a charge on the particles to change, said apparatus comprising:

a chamber with an inlet for the gas to enter and an outlet for the gas to exit, said chamber being surrounded by an enclosure with a conductive wall, the conductive wall being held at a ground potential;

an electrode with an exposed sharp tip said gas in said chamber, said electrode being held at a different potential than the conductive wall with the exposed tip placed adjacent to a first section of the conductive wall and wherein an electric field is developed in the chamber, the electric field being characterized by a potential gradient having a lower electric field intensity in an area of the chamber having a second section of the conductive wall located away from and further from the exposed sharp tip than the first section of the conductive wall and a higher electric field intensity existing between the exposed tip and the first section of the conductive wall;

said inlet and outlet defining a gas flow path from said inlet to said outlet such that said gas flow path passes mainly through the lower electric field of intensity between said exposed electrode tip and the second section of the conductive wall; and said electrode being connected to a source of voltage sufficient to cause a corona discharge to occur forming ions in said chamber; and wherein said chamber comprises a total interior volume in the range between approximately 6 and 600 cc.

2. The apparatus of claim 1 wherein said voltage source comprises a source of DC voltage capable of providing a DC voltage in the approximate range between 4000 to 7000 volts and sufficient to produce a DC current in an approximate range of 0.1 to 5 mA.

3. The apparatus of claim 1 wherein said voltage source comprises a source of AC voltage capable of providing an AC voltage in the approximate range between 4000 and 7000 volts in root-mean-square, i.e. rms value, and sufficient to produce a rms AC current in an approximate range of 0.1 to 5 mA.

4. A method of for conditioning a charge on particles in a gas to produce substantially equal concentrations of positively and negatively charged particles and a substantially zero total particle charge in said gas for aerosol measurement by differential mobility spectrometry, said method comprising;

causing said gas to flow through a chamber, the chamber having an inlet for the gas to enter and an outlet for the gas to exit;

creating an AC corona discharge within the chamber;

producing a high intensity region having a high electric field intensity and a lower intensity region with a lower electric field intensity, with the gas flow from inlet to outlet occurring mainly in the lower intensity region with the lower electric field intensity thereby creating a substantially equal concentrations of positively and negatively charged particles, and a substantially zero total particle charge in said gas; and wherein said chamber comprises a volume in the approximate range between 6 and 600 cc, and said method including flowing said gas with suspended particles through said chamber at a rate of gas flow to achieve a gas residence time in the chamber in the approximate range between 0.2 and 20 second.

5. The method of claim 4 wherein an AC voltage is used to create the AC corona discharge, said AC voltage having a root-mean-square value in the approximate range between 4000 to 7000 volts, sufficient to create an AC current with a root-mean-square current in the approximate range between 0.1 and 5 mA.

6. An apparatus for exposing particles in a gas to ions in order to cause a charge on the particles to change, said apparatus comprising:

a chamber with an inlet for the gas to enter and an outlet for the gas to exit, said chamber being surrounded by an enclosure with a conductive wall, the conductive wall being held at a ground potential;

an electrode with an exposed sharp tip in contact with said gas in said chamber, said electrode being held at a different potential than the conductive wall with the exposed tip placed adjacent to a first section of the conductive wall and wherein an electric field is developed in the chamber, the electric field being characterized by a potential gradient having a lower electric field intensity in an area of the chamber having a second section of the conductive wall located away from and further from the exposed sharp tip than the first section of the conductive wall and a higher electric field intensity existing between the exposed tip and the first section of the conductive wall;

said inlet and outlet defining a gas flow path from said inlet to said outlet such that said gas flow path passes mainly through the lower electric field of intensity between said exposed electrode tip and the second section of the conductive wall; and said electrode being connected to a source of voltage sufficient to cause a corona discharge to occur fowling ions in said chamber wherein the voltage source comprises at least one of 1) a source of AC voltage capable of providing an AC voltage in the approximate range between 4000 and 7000 volts in root-mean-square, i.e. rms value, and sufficient to produce a rms AC current in an approximate range of 0.1 to 5 mA or a DC voltage and 2) a source of DC voltage capable of providing a DC voltage in the approximate range between 4000 to 7000 volts and sufficient to produce a DC current in an approximate range of 0.1 to 5 mA.

7. The apparatus of claim 6 wherein said chamber comprises a volume in the approximate range between 6 and 600 cc.

* * * * *